United States Patent [19]

Abrahams

[11] 4,165,690

[45] Aug. 28, 1979

[54] DRILL UNITS FOR DRILLING AND CHARGE LAYING OPERATIONS AND METHOD OF CARRYING OUT THE OPERATIONS

[75] Inventor: Joseph L. Abrahams, Barrhead, Scotland

[73] Assignee: Rock Fall Company Limited, Glasgow, Scotland

[21] Appl. No.: 857,993

[22] Filed: Dec. 6, 1977

[30] Foreign Application Priority Data

Dec. 17, 1976 [GB] United Kingdom ..... 52717/76

[51] Int. Cl.[2] ..... E21B 7/00

[52] U.S. Cl. ..... 102/22 R; 102/23; 86/20 C; 175/2; 175/9; 175/52; 175/85

[58] Field of Search ..... 86/20 C; 102/22 R, 23; 175/2, 5, 9, 52, 85; 299/13

[56] References Cited

U.S. PATENT DOCUMENTS

| | | | |
|---|---|---|---|
| 3,286,777 | 11/1966 | Gyongyosi | 175/52 |
| 3,420,319 | 1/1969 | Lincoln et al. | 175/52 |
| 3,613,906 | 10/1971 | Deyo et al. | 175/85 |
| 3,623,771 | 11/1971 | Sosnowicz et al. | 102/23 |
| 3,741,320 | 6/1973 | Hilfing | 175/85 |
| 3,741,322 | 6/1973 | Wolters | 175/52 |
| 4,040,335 | 8/1977 | Hopler, Jr. | 86/20 C |

*Primary Examiner*—Verlin R. Pendegrass

[57] ABSTRACT

The invention provides for a drill unit for drilling and charge laying operations and is suitable for operation on land or underwater. The drill unit comprises a rock drill mounted on a frame structure on a gantry and drill steels and casing members located in a drill magazine where they can be moved into register with the drilling machine for drilling a hole below the gantry, the casing member being put down the hole to line it and a charge magazine containing explosive cartridges also mounted on the gantry provided with means for bringing a cartridge into register with a casing member put down a hole to charge the casing member. The operation being remotely controlled.

8 Claims, 5 Drawing Figures

DRILL UNITS FOR DRILLING AND CHARGE LAYING OPERATIONS AND METHOD OF CARRYING OUT THE OPERATIONS

This invention relates to drill units for drilling and charge laying operations and method of carrying out the operations.

More specifically the invention provides for a drill unit for carrying out drilling and charge laying operations associated with drilling, charging and blasting rock or other cohesive materials on land or under water, the drill unit being submersible can be located underwater and operated by remote control from land or from a floating craft.

According to one aspect of the invention a drill unit comprises a gantry, a vertically disposed frame structure mounted on the gantry, a rock drilling machine mounted for vertical movement on the frame structure, a first drill magazine mounted on the gantry adjacent the frame structure on a vertical plane and adapted to hold a plurality of drill steels having co-axial casing members mounted thereon, second drill magazine vertically mounted in spaced end-to-end relation with the first drill magazine adapted to hold used drill steels, said drill magazines having adjacent ends open, means for moving a drill steel and its associated casing member into alignment with the drilling machine for attachment thereto to drill a hole below the gantry and put a casing member down the hole, a charge magazine located adjacent the frame structure and adapted to hold a plurality of explosive cartridges, means for moving an explosive cartridge in the charge magazine into register with a casing member put down by the drilling machine to charge the hole with explosives.

According to another aspect of the invention a method of drilling and charging rock or other cohesive material for blasting operations comprises operating a drill unit constructed according to said one aspect of the invention by drilling a hole in cohesive material located below the gantry and putting down a casing member into the hole, removing the drill steel after drilling the hole and charging the hole with an explosive cartridge taken from a charge magazine.

An embodiment of the invention is illustrated by way of example in the accompanying drawings in which.

Figure 1:
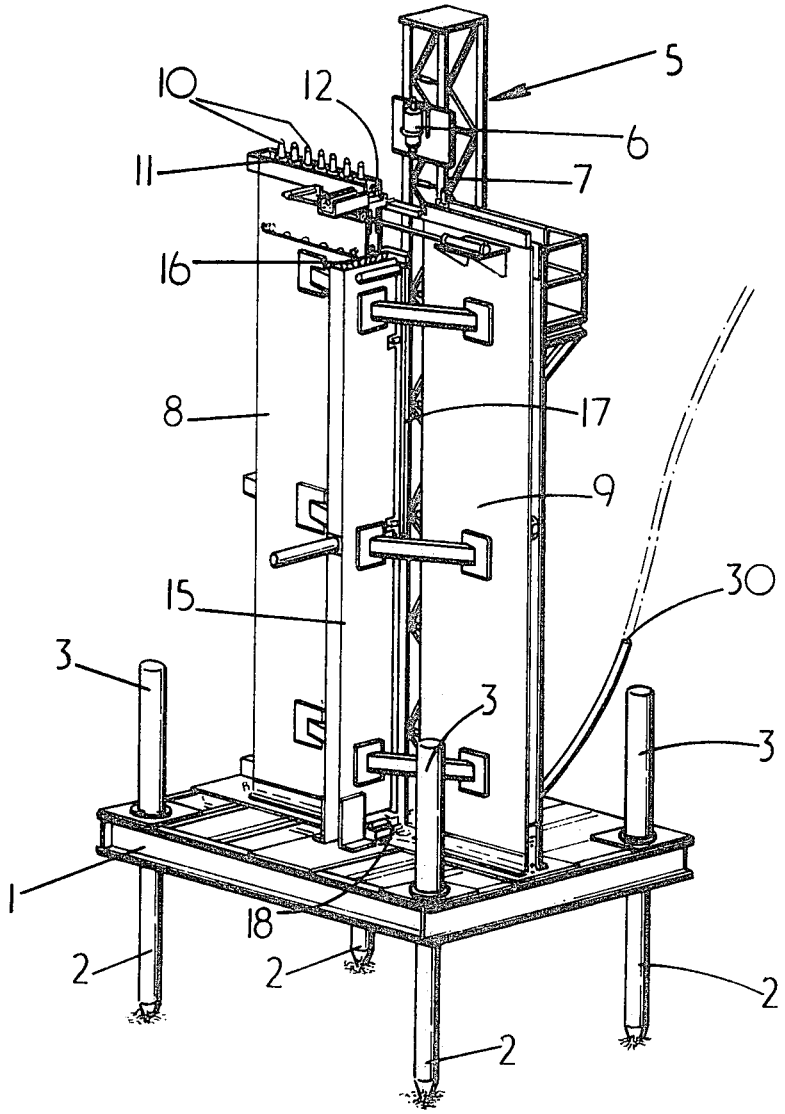
FIG. 1 is a perspective view of one embodiment of a drill unit according to the invention.
Figure 2:
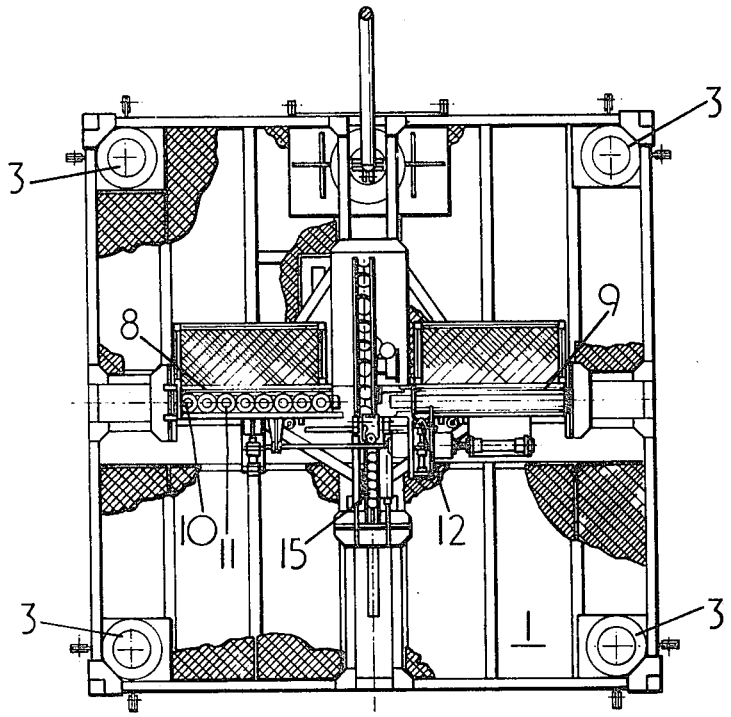
FIG. 2 is a top plan view of the drill unit illustrated in FIG. 1.
Figure 3:
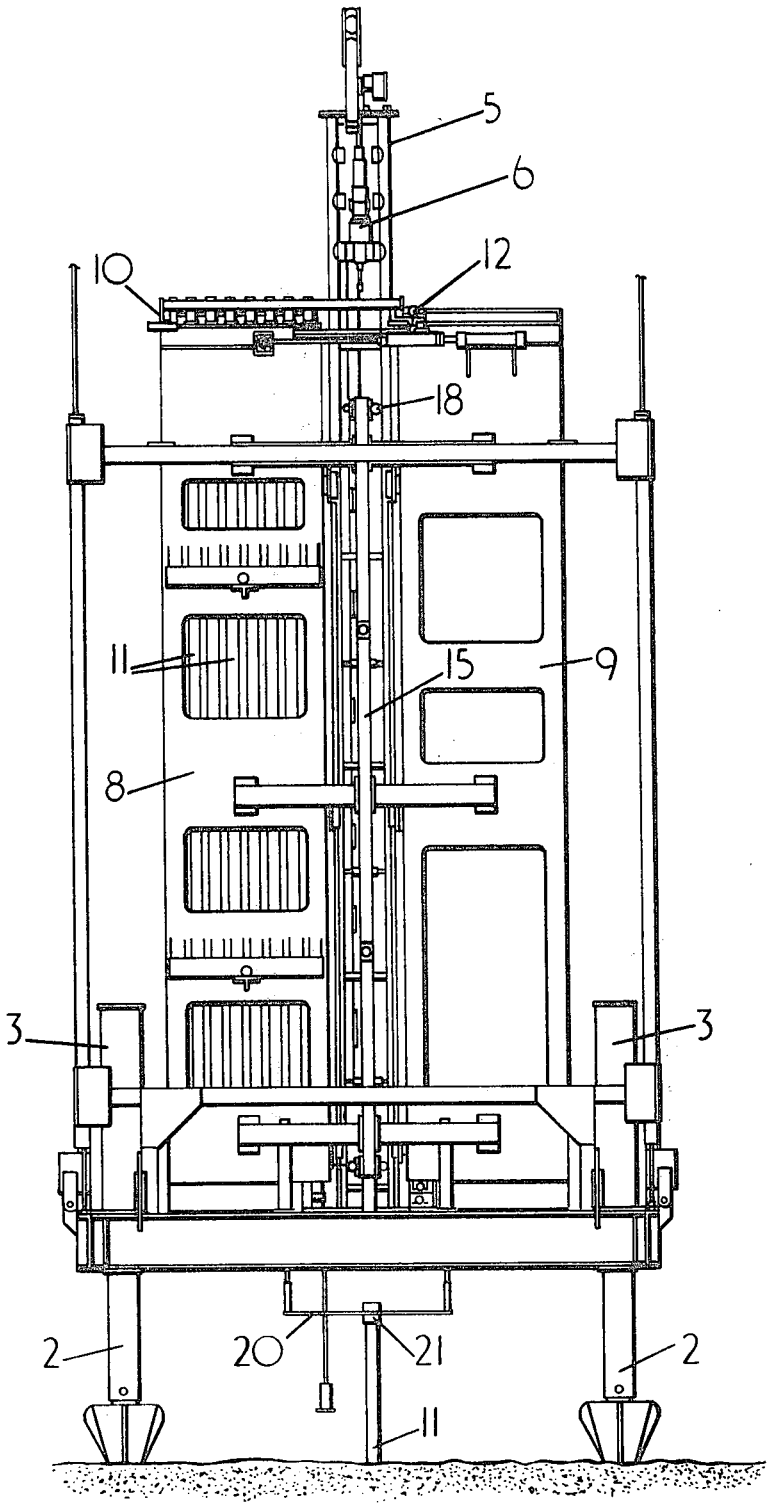
FIG. 3 is a front elevation of the drill unit of FIG. 1.
Figure 4:
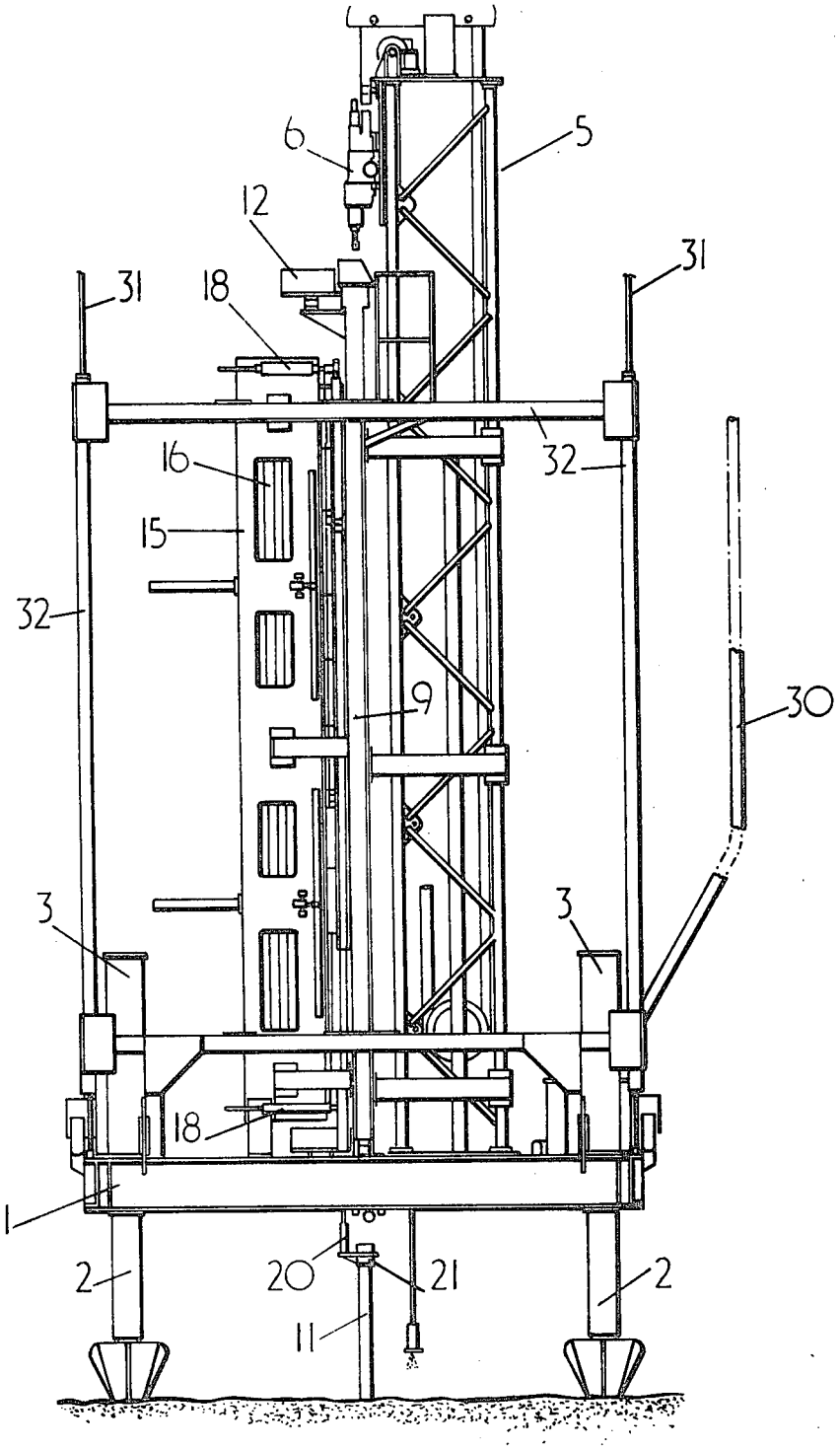
FIG. 4 is a side elevation of the drill unit of FIG. 1.

Referring to FIGS. 1 to 4 of the drawings, a drill unit comprises a gantry denoted generally at 1 which may be in the form of a platform or the like which is provided with adjustable support members 2 arranged adjacent each corner of the gantry and having pneumatic or hydraulic cylinders 3 which are actuated to adjust the length of the support members so as to support the gantry 1 on a horizontal plane.

A vertically disposed frame structure or mast 5 extends upwardly and is mounted on the gantry 1.

A drilling machine, in the form of a drill hammer denoted at 6, is mounted for vertical movement on guide members 7 on the frame structure 5.

Drill magazines 8 and 9 are mounted on a vertical plane and extend upwardly from the gantry in end-to-end spaced relation on each side of the frame structure. The drill magazine 8 provides for storing a plurality of drill strings or steels 10 in vertically disposed side-by-side relation. The adjacent ends of the magazines are open to allow the drill strings to be removed vertically therefrom and means are provided for retaining stored strings within the magazines. The steels or drill strings 10 have eccentric cutting elements at one end and the steels 10 in the magazine 8 each have a coaxial disposable casing member 11 mounted thereon by means of a sleeve member at the end of the steels opposite the cutting elements.

The eccentric cutting elements on the steels are retractable when the steels are rotated in a direction opposite to the direction of cutting so that the steel can be withdrawn through the casing member 11.

The casing member 11 may be of plastics material.

The magazine 9 is provided for storing used steels 10 withdrawn from their associated casing members. The used steels being stored in vertical side-by-side relation within the magazine 9.

Means are provided for moving the steels 10 and their associated casing members 11 in the direction of the open side of the magazine 8 when one of the steels and casing members is removed from the magazine 8.

Means in the form of a gripper member 12 is provided for gripping a steel and its associated casing member, removing it from the magazine 8 in a vertically disposed position and locating it in alignment with the drilling machine 6 where it is attached to the drilling machine.

The gripper member 12 is in the form of a clamp or finger members mounted on a piston rod which is movable between the open ends of the magazines 8 and 9 and in a direction at right angles thereto so as to remove a steel and casing member from the magazine 8, locate it in alignment with the drilling machine for attachment thereto and to grip and remove a used drill steel 10 from the drilling machine and move it into the magazine 9.

A charge magazine 15 is mounted on a vertical plane at right angle to the plane of the magazines 8 and 9. The charge magazine provides for storing a plurality of explosive cartridges 16 in vertically disposed side-by-side relation. The magazine is open at one side adjacent the frame structure 5 to allow for removal of an explosive cartridge in said vertical plane.

Means 17 in the form of a cartridge carrier is provided for gripping a cartridge in the magazine 9 and means 18 in the form of pistons for moving it into register with a casing member 11 put down a hole drilled by the drilling machine 6 and for moving the cartridge vertically into the casing member where the cartridge is released to fall into the casing so as to charge the casing.

A guide member denoted generally at 20 downwardly extendable beneath the gantry 1 is provided for positioning the end of a casing member 11 put down by the drilling machine.

The guide member includes a sleeve or collar member 21 which is located over the end of the casing member 11 extending from a hole below the gantry and is located on the casing member before withdrawal of the steel of drill string 10 from the casing member so as to hold the casing member vertical while the drill string is being withdrawn and the casing is being charged.

The method of operating the drill unit comprises locating the gantry on land or underwater over an area to be drilled and charged for blasting and lowering the support members to support the gantry in a horizontal disposed plane after filling the drill magazine 8 with steels 10 and associated casing members 11 and the charge magazine 15 with explosive cartridges, actuating the gripping means 12 to grip a steel and associated casing member in the magazine 8 and move it into register with the drilling machine, attaching the steel and associated casing member to the drilling machine and actuating the drilling machine to drill a hole and put down a casing member into the hole. After the casing member has been put down to the required depth, the upper end which extends upwardly from the hole is engaged by the collar member 21 of the guide member 20 which is lowered from the gantry. The steel is then withdrawn from the casing member so as to leave the casing member in the hole. The cartridge carrier 17 is then actuated to grip and remove a cartridge from the charge magazine 15 and to locate it over the casing put down by the drilling machine. When the cartridge is so located it is moved downwardly into the casing where it is released to fall into and charge the casing. The guide member releases the casing member and is withdrawn so that the drill unit can be moved to another location.

The means for moving the steels and associated casing members stored in the magazine 8 in the direction of the open side of the magazine and for moving the used steels into and along the magazine 9 may be in the form of a chain mechanism located at the end of the magazines adjacent the gantry.

All of the mechanism may be remotely controlled and a conduit 30 is connected to a control panel (not shown). When the drill unit is used underwater the gantry may be lowered on to the sea bed or overburden by a crane, winch or the like mounted on land or in a floating craft and connected by cables 31 to struts 32 secured to the gantry.

Figure 5:
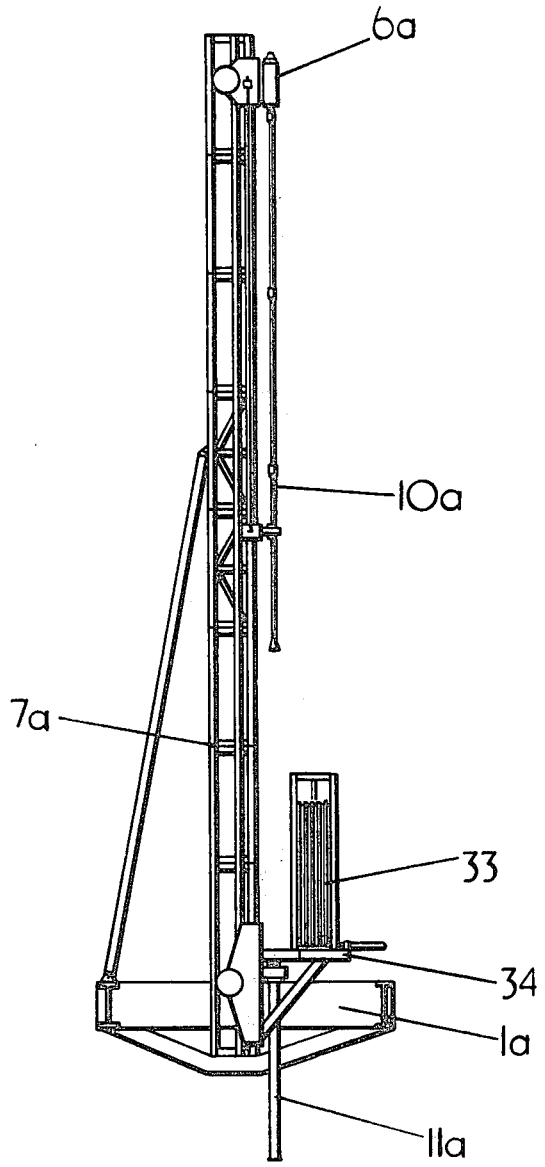
FIG. 5 is a side view of another embodiment of a drill unit according to the invention.

Referring to FIG. 5 which illustrate another embodiment of the invention the gantry 1*a* and frame structure 7*a* are the same as above described and a drilling machine 6*a* is mounted on the frame structure for vertical movement thereon.

The drilling machine 6*a* may be of the same construction as above described or may include a casing drive member which provides for putting down a casing member into a hole drilled by the drilling machine to line the hole or collar the hole in cohesive material a sufficient distance to seal the hole from surrounding overburden.

The drill strings 10*a* and casing member 11*a* may be formed by elongate portions attachable to each other. The drilling machine and casing drive member may be mounted co-axially on the structure and may be independently movable vertically of the structure.

A charge magazine 33 differs from the charge magazine described in the previous embodiment in that it is a rotatable magazine mounted on a cradle 34 for movement into register with a casing member put down by the drilling machine. The charge magazine 33 is movable on a horizontal plane and is rotatable so that a charge of explosives from the magazine can selectively be brought into and out of register with a casing member located below the gantry in a hole drilled by the drilling machine. A charge of explosives can then be transferred from the magazine into the casing member 11*a* which can thereafter be withdrawn or left in position in the hole.

What is claimed is:

1. A drill unit for drilling and charge laying operations comprising a gantry, a vertically disposed frame structure mounted on the gantry, a rock drilling machine mounted for vertical movement on the frame structure, a first drill magazine mounted on the gantry adjacent the frame structure on a vertical plane and adapted to hold a plurality of drill steels having co-axial casing members mounted thereon, a second drill magazine vertically mounted in spaced end-to-end relation with the first drill magazine adapted to hold used drill steels, said drill magazines having adjacent ends open, means for moving a drill steel and its associated casing member into alignment with the drilling machine for attachment thereto to drill a hole below the gantry and put a casing member down the hole a charge magazine located adjacent the frame structure and adapted to hold a plurality of explosive cartridges, means for moving an explosive cartridge in the charge magazine into register with a casing member put down by the drilling machine to charge the hole with explosives.

2. A drill unit according to claim 1 in which the charge magazine is vertically mounted on the gantry on a plane at right angles to the drill magazines and in which the explosive cartridges are arranged in the magazine in a vertically disposed side-by-side relation and the magazine is open at the end adjacent the frame structure.

3. A drill unit according to claim 1 in which the means for moving an explosive cartridge from the charge magazine comprises a cartridge carrier adapted to grip a cartridge at the open end of the magazine and to move it in a vertical plane into alignment with a casing member put down by the drilling machine and to put the cartridge down into the casing member.

4. A drill unit according to claim 1 wherein the means for removing a drill steel and casing member from the first drill magazine comprises gripper means movable between the first and second drill magazines and engageable with a drill steel and casing member located at the open end of the first drill magazine and operative to move the drill steel and casing member into alignment with and for attachment to the drilling machine, said gripper means also operative to grip a drill steel in the drilling machine, remove the drill steel from the drilling machine and transfer the used drill string into the second drill magazine.

5. A drill unit according to claim 1 in which the charge magazine is rotatably mounted on a cradle adjacent the frame structure and movable on a vertical plane towards and away from the frame structure whereby an explosive cartridge in the magazine can be brought into register with a casing member put down by the drilling machine.

6. A drill unit according to claim 1 including adjustable support members which extend below the gantry.

7. A drill unit according to claim 1 including guide means located and extendable below the gantry, said guide means engageable with the casing member put down by the drilling machine.

8. A method of drilling and charging rock or other cohesive material for blasting operations comprising operating a drill unit as claimed in claim 1 by drilling a hole in cohesive material located below the gantry and putting down a casing member into the hole, removing the drill steel after drilling the hole and charging the hole with an explosive cartridge taken from a charge magazine.

* * * * *